US008508146B2

(12) United States Patent
Hirano et al.

(10) Patent No.: US 8,508,146 B2
(45) Date of Patent: Aug. 13, 2013

(54) ELECTRONIC DEVICE, CONTROL CIRCUIT, AND METHOD FOR CONTROLLING LIGHT EMITTING ELEMENT

(75) Inventors: Takeshi Hirano, Kasugai (JP); Tomokazu Yamada, Kasugai (JP)

(73) Assignee: Fujitsu Semiconductor Limited, Yokohama (JP)

( * ) Notice: Subject to any disclaimer, the term of this patent is extended or adjusted under 35 U.S.C. 154(b) by 133 days.

(21) Appl. No.: 13/305,684

(22) Filed: Nov. 28, 2011

(65) Prior Publication Data

US 2012/0206058 A1 Aug. 16, 2012

(30) Foreign Application Priority Data

Feb. 14, 2011 (JP) ..... 2011-028878

(51) Int. Cl.
*H05B 37/02* (2006.01)

(52) U.S. Cl.
USPC ..... 315/245; 315/227 R

(58) Field of Classification Search
None
See application file for complete search history.

(56) References Cited

U.S. PATENT DOCUMENTS 6,476,564 B1 * 11/2002 Tsuchida ..... 315/241 P

FOREIGN PATENT DOCUMENTS

JP 2010-122336 A 6/2010
WO WO-2004/019148 A1 3/2004

* cited by examiner

*Primary Examiner* — Crystal L Hammond
(74) *Attorney, Agent, or Firm* — Fujitsu Patent Center

(57) ABSTRACT

An electronic device including a light emitting element. A capacitor is coupled to the light emitting element. A measurement circuit measures a change amount in charge of the capacitor. A control circuit controls a light emission amount of the light emitting element in accordance with a difference of the change amount in the charge and a reference value.

10 Claims, 4 Drawing Sheets

ELECTRONIC DEVICE, CONTROL CIRCUIT, AND METHOD FOR CONTROLLING LIGHT EMITTING ELEMENT

CROSS-REFERENCE TO RELATED APPLICATIONS

This application is based upon and claims the benefit of priority from prior Japanese Patent Application No. 2011-028878, filed on Feb. 14, 2011, the entire contents of which are incorporated herein by reference.

FIELD

The present embodiment relates to an electronic device, a control circuit, and a method for controlling a light emitting element.

BACKGROUND

Japanese Laid-Open Patent Publication No. 2010-122336 describes an example of constant current control on a light emitting diode (LED) with a DC-DC converter. Further, as described in WO2004/019148, a sense resistor and an FET may be coupled in series to a light emitting diode string. In this case, the current flowing through the light emitting diode is measured from the voltage generated by the sense resistor to control the ON resistance of the FET based on the measurement. This controls the current flowing through the light emitting diode to be generally constant.

When executing constant current control with a DC-DC converter, the current flowing through the light emitting diode is not directly monitored. Thus, when variations occur between light emitting diodes or elements, the current flowing through the light emitting diode also varies. This results in the necessity to provide an excessive design margin for the current. Further, when monitoring the current that flows through a light emitting diode with a sense resistor, a loss results from the sense resistor.

SUMMARY

One aspect of the embodiments is an electronic device that includes a light emitting element, a capacitor coupled to the light emitting element, a measurement circuit that measures a change amount in charge of the capacitor, and a control circuit that controls a light emission amount of the light emitting element in accordance with a difference of the change amount in the charge and a reference value.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory and are not restrictive of the invention, as claimed.

BRIEF DESCRIPTION OF THE DRAWINGS

The invention, together with objects and advantages thereof, may best be understood by reference to the following description of the presently preferred embodiments together with the accompanying drawings in which.

DESCRIPTION OF EMBODIMENTS

Figure 1:
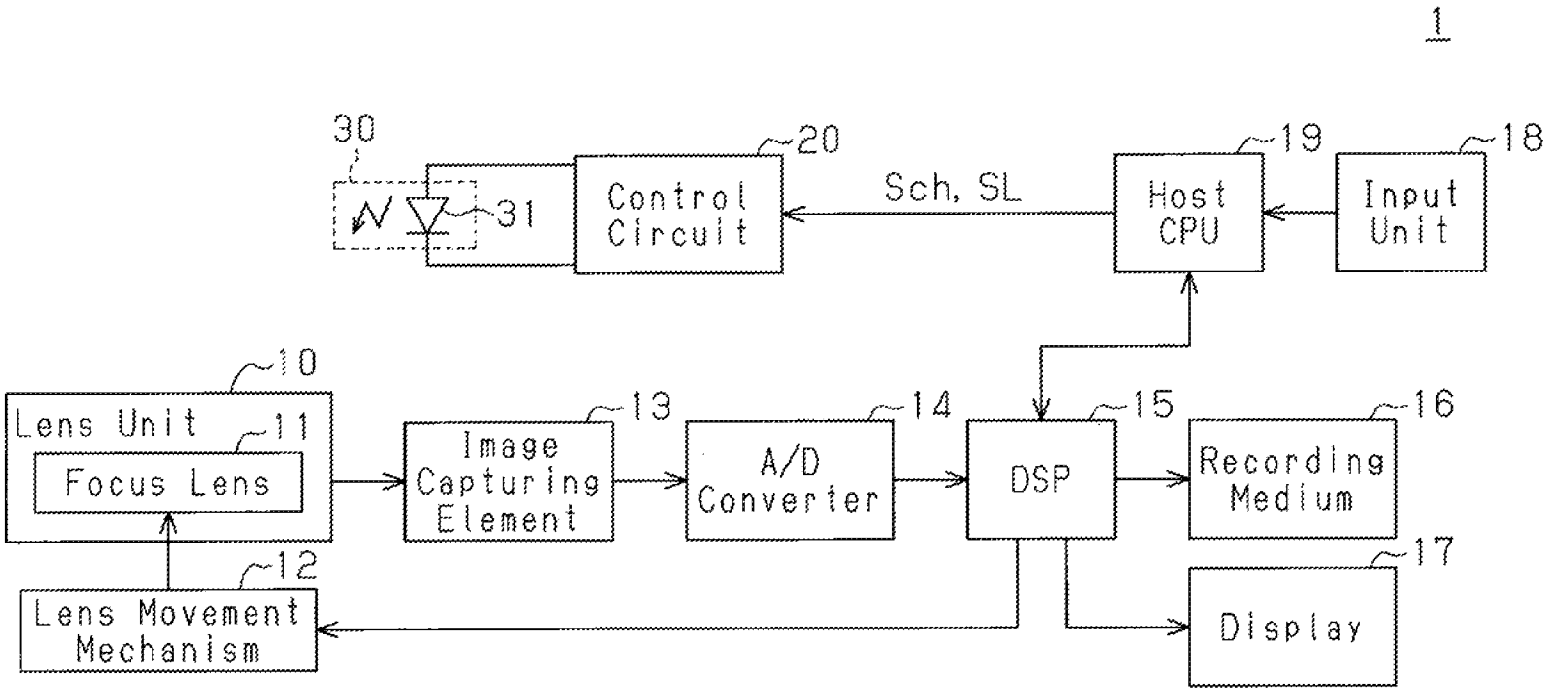
FIG. 1 is a block diagram illustrating the entire structure of a digital camera in one embodiment.
Figure 2:
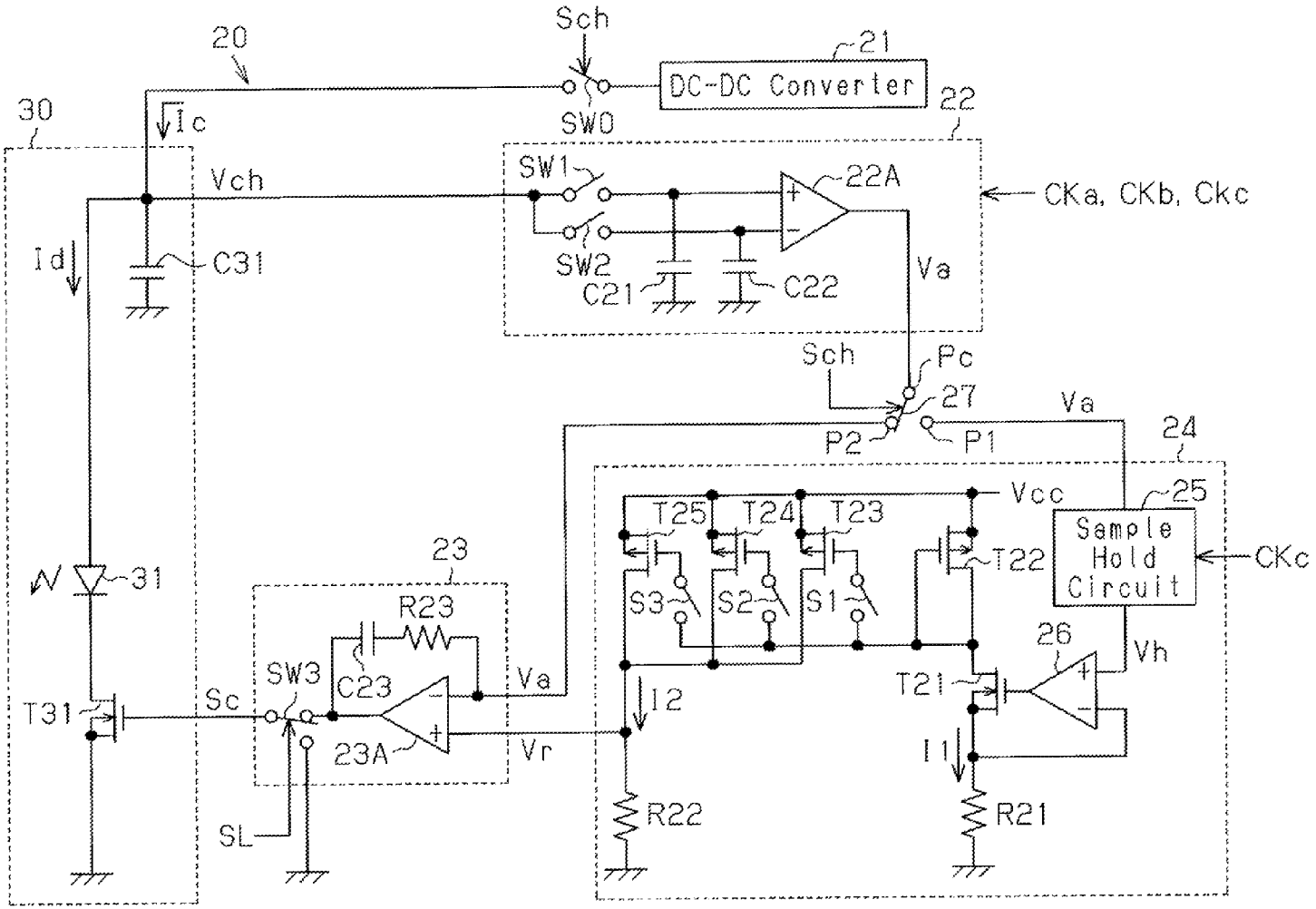
FIG. 2 is a block circuit diagram illustrating one example of the configuration of a control circuit.

One embodiment will now be described with reference to FIGS. 1 to 4. First, the entire structure of a digital camera 1 will now be described with reference to FIG. 1.

A lens unit 10 includes lenses (focus lens 11 and the like), which collect light from an object, and a diaphragm (not illustrated), which adjusts the amount of light passing through the lenses in accordance with the illuminance of the object. The lens unit 10 sends the collected light from the object to an image capturing element 13. A focus lens 11, which adjusts the focus, is driven by a lens movement mechanism 12 and moved toward the front and rear along an optical axis. The lens movement mechanism 12 is controlled and driven by a control signal from a digital signal processor (DSP) 15.

The image capturing element 13 includes a color filter with a Bayer array and sends an image capturing signal (analog signal), which is in accordance with the light entering through the lens unit 10, to an analog to digital (A/D) converter 14. A charge coupled device (CCD) image sensor, a complementary metal oxide semiconductor (CMOS), or the like may be used as the image capturing element 13.

The A/D converter 14 converts the image capturing signal to a digital signal. Then, the A/D converter 14 sends the digital signal as image data to the DSP 15.

The DSP 15 performs various types of image processing on the image data received from the A/D converter 14 and stores the image-processed image data in a recording medium 16 or sends the image-processed image data to a display 17. A portable memory card, such as COMPACTFLASH (registered trademark) or an SD MEMORY CARD (registered trademark), may be used as the recording medium 16. A liquid crystal display (LCD) or organic electronic luminescence (EL) may be used as the display 17.

An input unit 18 includes switches operated by a user, such as a shutter button and a menu button. The user operates the switches to take a photograph or select a shooting mode. For example, when the shutter button is half-pressed, a shooting preparation process, such as auto-focus control, is performed, and when the shutter button is fully pressed, an actual shooting process is performed. When the shutter button or the like is operated, the input unit sends a corresponding operation signal to a host CPU 19.

The host CPU 19 executes various types of programs, which are stored in a ROM (not illustrated), based on operation signals from the input unit 18 and centrally controls individual parts of the digital camera 1. The host CPU 19 controls with the DSP 15 and controls a control circuit (electronic flash driver circuit) 20. For example, when the shutter button is fully pressed and an operation signal of a shooting command is received by the input unit 18, the host CPU 19 sends a light emission signal SL to the control circuit 20 so that a light emission unit 30 generates light.

The control circuit 20 drives and controls the light emission unit 30 in accordance with control signals (e.g., light emission signal SL and charge signal Sch) from a host CPU 19. For example, the control circuit 20 emits light from a light emitting diode 31 in the light emission unit 30 for a certain period required for shooting at a shooting timing.

The configuration of the control circuit 20 and the light emission unit 30 will now be described.

The light emission unit 30 includes the light emitting diode 31, a capacitor C31, and an N-channel MOS transistor T31. The capacitor C31 includes a first terminal coupled to the anode of the light emitting diode 31 and a second terminal coupled to ground. The N-channel MOS transistor T31 includes a drain coupled to the cathode of the light emitting diode 31 and a source coupled to ground.

The control circuit 20 includes a DC-DC converter 21, a measurement circuit 22, and a control unit 23. The DC-DC converter 21 supplies the capacitor C31 with current Ic. The measurement circuit 22 measures a change amount in the charge of the capacitor C31. The control unit 23 controls a light emission amount of the light emitting diode 31 in accordance with the difference between an amplified voltage Va, which corresponds to the change amount in the charge of the capacitor C31, and a reference voltage Vr. Further, the control circuit 20 includes a reference value generation circuit 24 and a selector 27. The reference value generation circuit 24 generates the reference voltage Vr in accordance with the amount of change in the charge of the capacitor C31. The selector 27 couples the measurement circuit 22 selectively to one of the control unit 23 and the reference value generation circuit 24.

The DC-DC converter 21 is coupled via a switch SW0 to the anode of the light emitting diode 31, the first terminal of the capacitor C31, and the measurement circuit 22. When the switch SW0 is activated, the DC-DC converter 21 supplies the capacitor C31 with output voltage, which is controlled at a constant voltage, so that constant current Ic flows through the capacitor C31 (charge period). The current charges the capacitor C31 and raises the voltage (charge voltage Vch) at the first terminal of the capacitor C31 at a constant inclination (constant rate). When the switch SW0 is inactivated, drive current Id flows from the capacitor C31 to the light emitting diode 31. This generates a flash of light with the light emitting diode 31 (discharge period).

The switch SW0 is activated when the charge signal Sch received from the host CPU 19 (refer to FIG. 1) has an H level and inactivated when the charge signal Sch has an L level. The charge signal Sch has, for example, an H level when the shutter button is half-pressed and an L level when the charge voltage Vch of the capacitor C31 reaches a certain set voltage.

The configuration of the measurement circuit 22 will now be described.

The measurement circuit 22 includes switches SW1 and SW2, each including a first terminal that is coupled to a first terminal of a capacitor C3. The switch SW1 includes a second terminal coupled to a first terminal of a capacitor C21 and a non-inverting input terminal of an operational amplifier 22A. The capacitor C21 includes a second terminal coupled to ground. The switch SW2 includes a second terminal coupled to a first terminal of a capacitor C22 and an inverting input terminal of the operational amplifier 22A. The capacitor C22 includes a second terminal coupled to ground. In the present embodiment, the capacitance of the capacitor C21 has the same value as that of the capacitor C22.

Figure 3:
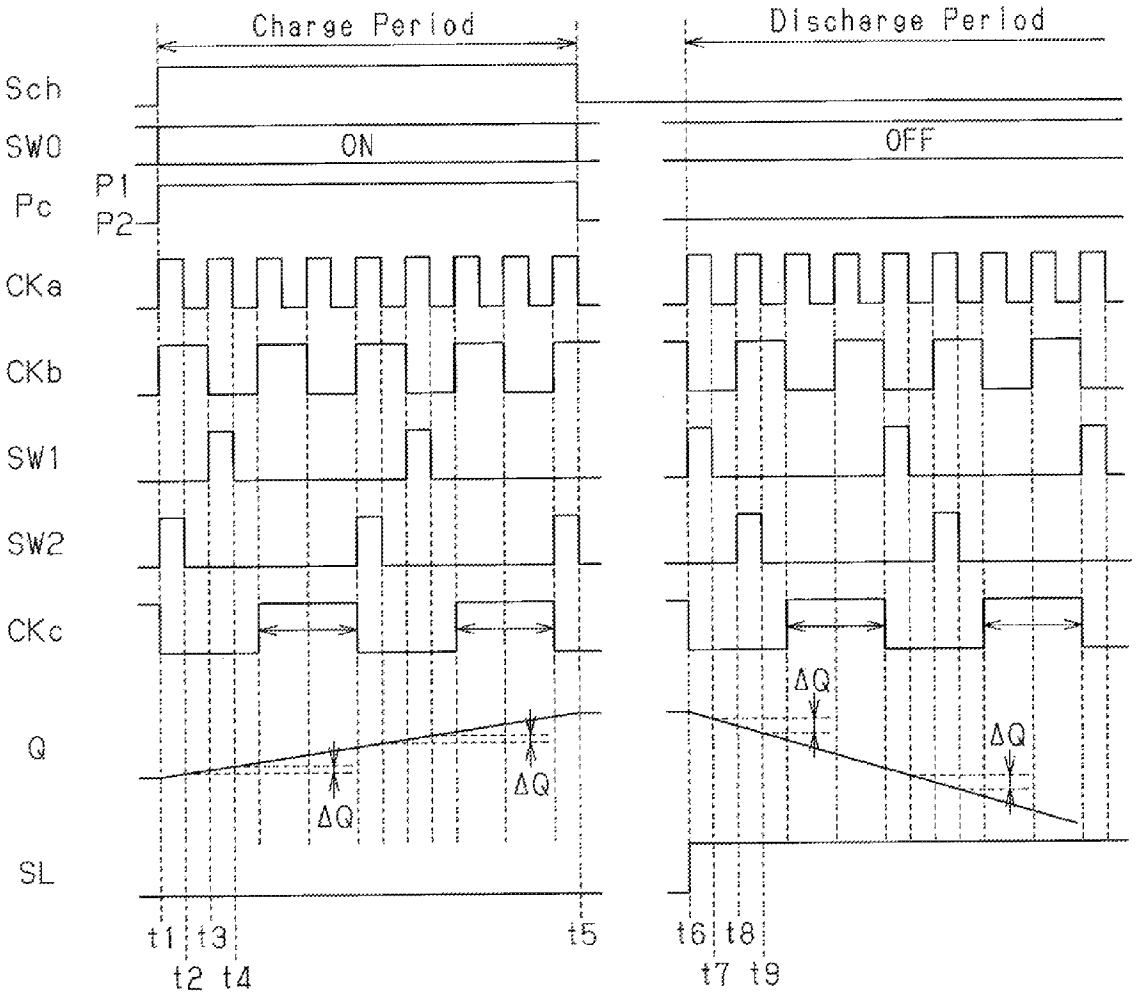
FIG. 3 is a timing chart illustrating the operation of the control circuit.

The activation and inactivation of the switches SW1 and SW2 are controlled in accordance with the signal level combination of three clock signals CKa, CKb, and CKc. As illustrated in FIG. 3, the clock signal CKa has a certain frequency, and the clock signal CKc is obtained by dividing the frequency of the clock signal CKa by four. During the charge period of the capacitor C31, the clock signal CKb is obtained by logically inverting the frequency of the clock signal CKa that is divided by two. During the discharge period of the capacitor C31, the clock signal CKb is obtained by dividing the frequency of the clock signal CKa by two. The switch SW1 is activated when the clock signals CKa, CKb, and CKc simultaneously have an H level, an L level, and an L level, respectively. The switch SW1 is inactivated by any other combination of the signal levels. The switch SW2 is activated when the clock signals CKa, CKb, and CKc simultaneously have an H level, an H level, and an L level, respectively. The switch SW2 is inactivated by any other combination of the signal levels.

When the switch SW1 is activated, the charge voltage Vch of the capacitor C31 is supplied to the non-inverting input terminal of the operational amplifier 22A. The charge voltage Vch is also supplied to the first terminal of the capacitor C21. Thus, the voltage at the first terminal of the capacitor C21 is equal to the charge voltage Vch of the capacitor C31.

When the switch SW1 is inactivated, the non-inverting input terminal of the operational amplifier 22A and the first terminal of the capacitor C21 are not supplied with the charge voltage Vch. As a result, the voltage at the non-inverting input terminal of the operational amplifier 22A becomes the voltage at the first terminal of the capacitor C21, that is, the voltage held by the capacitor C21 immediately before inactivation of the switch SW1. In this state, the voltage held by the capacitor C21 has a value corresponding to the charged amount of the capacitor C31 at the time the switch SW1 is inactivated.

In the same manner, when the switch SW2 is activated, the charge voltage Vch of the capacitor C31 is supplied to the inverting input terminal of the operational amplifier 22A. The charge voltage Vch is also supplied to the first terminal of the capacitor C22. Thus, the voltage at the first terminal of the capacitor C22 is equal to the charge voltage Vch of the capacitor C31.

When the switch SW2 is inactivated, the inverting input terminal of the operational amplifier 22A and the first terminal of the capacitor C22 are not supplied with the charge voltage Vch. As a result, the voltage at the inverting input terminal of the operational amplifier 22A becomes the voltage at the first terminal of the capacitor C22, that is, the voltage held by the capacitor C22 immediately before inactivation of the switch SW2. In this state, the voltage held by the capacitor C22 has a value corresponding to the charged amount of the capacitor C31 at the time the switch SW2 is inactivated.

The operational amplifier 22A provides the control unit 23 or the reference value generation circuit 24 with the amplified voltage Va, which is obtained by amplifying the difference between the voltages at its two input terminals. The operational amplifier 22A includes an output terminal coupled to a common terminal Pc of the selector 27. The amplified voltage Va is the difference between the voltage corresponding to the amount of charge at the capacitor C31 when the switch SW1 is inactivated and the voltage corresponding to the amount of charge at the capacitor C31 when the switch SW2 is inactivated. Thus, the amplified voltage Va corresponds to a change amount $\Delta Q$ (refer to FIG. 3) in the charge Q of the capacitor C31.

In addition to the common terminal Pc, the selector 27 includes a first terminal P1 and a second terminal P2. The common terminal Pc of the selector 27 may be coupled selectively to one of the first terminal P1, which is coupled to the reference value generation circuit 24, and the second terminal P2, which is coupled to the control unit 23. The switching of the selector 27 is controlled in accordance with the signal level of the charge signal Sch. For example, the selector 27 couples the common terminal Pc and first terminal P1, that is, the measurement circuit 22 and the reference value generation circuit 24, when the charge signal Sch has an H level and couples the common terminal Pc and second terminal P2, that is, the measurement circuit 22 and the control unit 23, when the charge signal Sch has an L level.

The configuration of the reference value generation circuit 24 will now be described.

The reference value generation circuit 24 includes a sample hold circuit 25, which is coupled to the first terminal P1 of the selector 27. Thus, when the common terminal Pc and first terminal P1 of the selector 27 are coupled to the sample hold circuit 25, that is, when charging the capacitor C31, the sample hold circuit 25 is supplied with the amplified voltage Va from the measurement circuit 22. Further, the sample hold circuit 25 is provided with the clock signal CKc as a sampling clock. In response to the clock signal CKc, the sample hold circuit 25 samples and holds the amplified voltage Va to generate a hold voltage Vh. In the present embodiment, during a period in which an L level clock signal CKc is received, the sample hold circuit 25 holds the amplified voltage Va input immediately before the clock signal CKc falls and sends the held amplified voltage Va as a hold voltage Vh to the non-inverting input terminal of an operational amplifier 26. Further, during a period in which an H level clock signal CKc is received, the sample hold circuit 25 directly sends the amplified voltage Va from the measurement circuit 22 as the hold voltage Vh to the non-inverting input terminal of the operational amplifier 26.

The output terminal of the operational amplifier 26 is coupled to the gate of an N-channel MOS transistor T21. The transistor T21 includes a drain coupled to the drain of a P-channel MOS transistor T22 and a source coupled to both of the inverting input terminal of the operational amplifier 26 and a first terminal of the resistor R21. The resistor R21 includes a second terminal, which is coupled to ground.

The operational amplifier 26 controls the transistor T21 so that the voltage at the inverting input terminal is equal to the hold voltage Vh. That is, the voltage at the first terminal of the resistor R21 is controlled to become the hold voltage Vh. Accordingly, current I1 flows between the two terminals of the resistor R21. The current I1 is in accordance with the resistance of the resistor R21 and the potential difference between the two terminals of the resistor R21 (hold voltage Vh). The current I1 is proportional to the hold voltage Vh (amplified voltage Va).

The source of the transistor T22 is supplied with high potential power supply voltage Vcc. The gate of the transistor T22 is coupled to the drain of the same transistor T22 and to the gates of P-channel MOS transistors T23, T24, and T25 respectively via switches S1, S2, and S3. The sources of the transistors T23, T24, and T25 are supplied with the power supply voltage Vcc. Accordingly, when the switch S1 is activated, the transistors T22 and T23 function as a current mirror circuit. When the switch S2 is activated, the transistors T22 and T24 function as a current mirror circuit. When the switch S3 is activated, the transistors T22 and T25 function as a current mirror circuit. In accordance with the electrical characteristics of the input side transistor T22 and the output side transistors T23, T24, and T25, the current mirror circuits send a current proportional to the current I1 flowing through the resistor R21 to an output side transistor.

The drains of the output side transistors T23, T24, and T25 are commonly coupled to the first terminal of the resistor R22, and the second terminal of the resistor R22 is coupled to ground. Thus, the resistor R22 is supplied with current that is in accordance with the current I1, which is proportional to the hold voltage Vh, from the current mirror circuit selected by the activation and inactivation of the switches S1 to S3. For example, when the output side transistor T23 has the same electrical characteristics as the input side transistor T22 and only the switch S1, which is coupled to the output side transistor T23, is activated, the resistor R22 is supplied with current I2, which has the same value as current I1. The setting of the electrical characteristics of the output side transistors T23, T24, and T25 and the setting of the activation and inactivation of the switches S1 to S3 are determined, for example, in accordance with the characteristics and quantity of the light emitting diode 31 coupled to the control circuit 20.

The voltage at the first terminal of the resistor R22 that is determined in accordance with the resistance of the resistor R22 and the value of the current I2 is supplied as the reference voltage Vr to a non-inverting input terminal of an operational amplifier 23A.

The reference value generation circuit 24 holds the amplified voltage Va (change amount ΔQ in the charge Q of the capacitor C31) during charging of the capacitor C31 as the hold voltage Vh and generates the reference voltage Vr in accordance with the hold voltage Vh. During discharging of the capacitor C31, the common terminal Pc and second terminal P2 of the selector 27 are coupled to each other, and the reference value generation circuit 24 is decoupled from the measurement circuit 22. However, the sample hold circuit 25 holds the amplified voltage Va. Thus, the control unit 23 is supplied with the reference voltage Vr that is generated in accordance with the amplified voltage Va (hold voltage Vh).

The configuration of the control unit 23 will now be described.

An inverting input terminal of the operational amplifier 23A is coupled to the second terminal P2 of the selector 27. Thus, when the common terminal Pc and second terminal P2 of the selector 27 are coupled to the inverting input terminal of the operational amplifier 23A, that is, during discharging of the capacitor C31, the inverting input terminal of the operational amplifier 23A is supplied with the amplified voltage Va from the measurement circuit 22. An output terminal of the operational amplifier 23A is coupled via a switch SW3 to the gate of the N-channel MOS transistor T31. Further, the output terminal of the operational amplifier 23A is coupled via a capacitor C23 and a resistor R23 to the inverting input terminal of the operational amplifier 23A. The operational amplifier 23A supplies a first terminal of the switch SW3 with an output voltage that is in accordance with the difference between the amplified voltage Va and the reference voltage Vr. For example, the operational amplifier 23A generates output voltage (control signal) that controls the ON resistance of the transistor T31 in accordance with the difference between the amplified voltage Va and the reference voltage Vr.

The switch SW3 includes a common terminal coupled to the gate of the transistor T31, a first terminal coupled to the output terminal of the operational amplifier 23A, and a second terminal coupled to ground. The switching of the switch SW3 is controlled in accordance with the signal level of the light emission signal SL from the host CPU 19 (refer to FIG. 1). For example, the switch SW3 couples the common terminal and the first terminal in accordance with an H level light emission signal SL that instructs light emission of the light emitting diode 31. Further, the switch SW3 couples the common terminal and the second terminal in accordance with an L level light emission signal SL. The switch SW3 supplies the gate of the transistor T31 with the output voltage of the operational amplifier 23A or a ground level voltage as a control signal Sc. The transistor T31 is activated by the output voltage of the operational amplifier 23A and inactivated by the ground level voltage.

The control unit 23 provides the gate of the transistor T31 with a ground level control signal Sc until receiving an H level light emission signal SL. As a result, the transistor T31 is inactivated and drive current Id does not flow to the light emitting diode 31. Thus, the light emitting diode 31 does not emit light. When receiving the H level light emission signal SL that instructs light emission of the light emitting diode 31, the control unit 23 supplies the gate of the transistor T31 with the control signal Sc, which is in accordance with the difference between the amplified voltage Va and the reference voltage Vr. The ON resistance of the transistor T31 is varied in accordance with the increase and decrease of the control signal Sc. This varies the drive current Id flowing through the light emitting diode 31 and varies the light emission amount of the light emitting diode 31. In this state, a feedback loop is formed extending from the control unit 23 to the light emission unit 30, the measurement circuit 22, the selector, and back to the control unit 23. Formation of the feedback loop controls the ON resistance of the transistor T31 so that the amplified voltage Va (change amount ΔQ in the charge Q of the capacitor C31) becomes equal to the reference voltage Vr. This controls the light emission amount of the light emitting diode 31 to be generally constant.

The digital camera 1 is one example of an electronic device, the DC-DC converter 21 is one example of a power supply circuit, the control unit 23 is one example of a comparison circuit, the light emitting diode 31 is one example of a light emitting element, the transistor T31 is one example of a resistor element, and the reference voltage is one example of a reference value.

Figure 4:
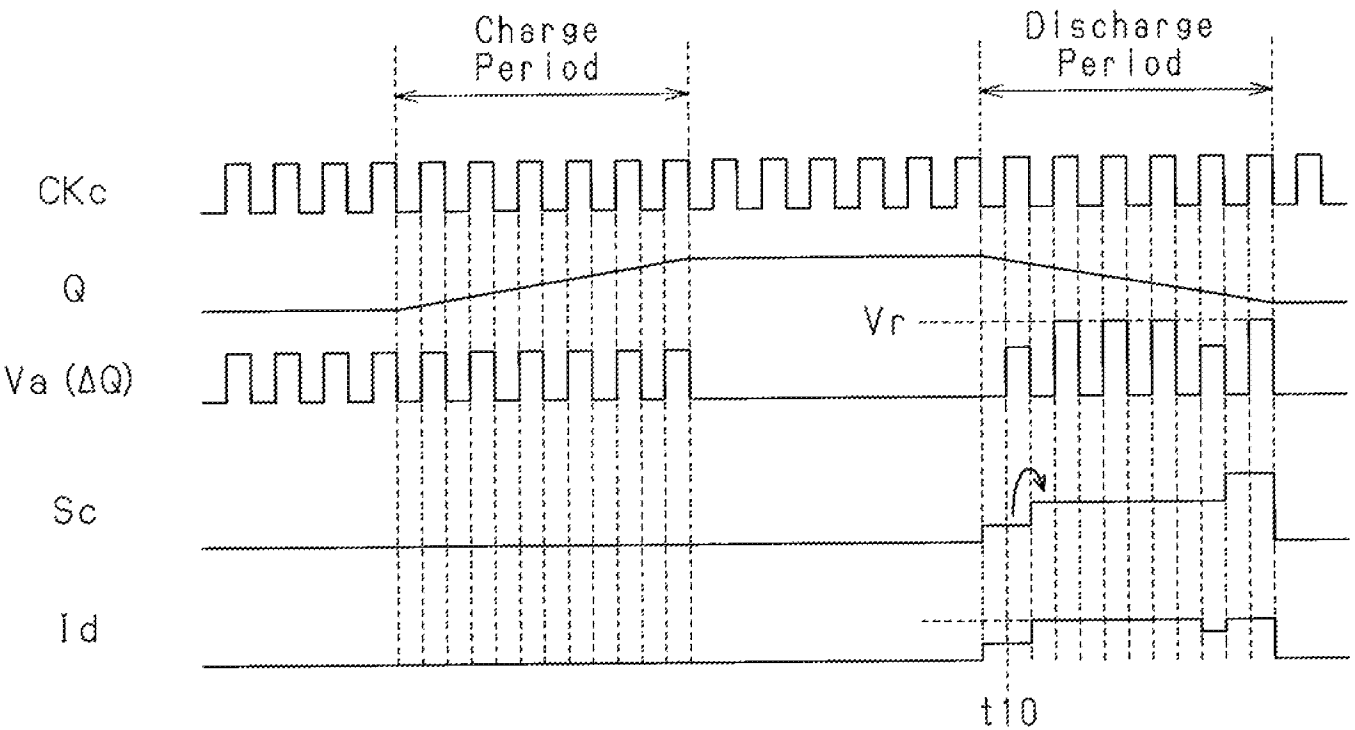
FIG. 4 is a timing chart illustrating the operation of the control circuit.

The operation of the control circuit 20 will now be described with reference to FIGS. 3 and 4. The vertical axes and horizontal axes illustrated in FIGS. 3 and 4 are reduced or enlarged in scale for the sake of brevity.

When, for example, a user half-presses the shutter button and starts a shooting preparation process, the host CPU 19 sends an H level charge signal Sch to the control circuit 20 (time t1). In the control circuit 20, the H level charge signal Sch activates the switch SW0, couples the common terminal Pc and first terminal P1 of the selector 27, and couples the measurement circuit 22 and the reference value generation circuit 24. As a result, the capacitor C31 is charged by the generally constant current Ic output from the DC-DC converter 21. This increases the charge Q of the capacitor C31 at a constant inclination.

In this state, an oscillator or frequency divider (not illustrated) generates the clock signal CKa, which has a certain frequency, the clock signal CKb, which is obtained by logically inverting the frequency of the clock signal CKa that is divided by two, and the clock signal CKc, which is obtained by dividing the frequency of the clock signal CKa by four. When the clock signals CKa, CKb, and CKc respectively have an H level, an H level, and an L level, the switch SW2 is activated. As a result, the voltage at the first terminal of the capacitor C22 becomes equal to the charge voltage Vch of the capacitor C31. Then, when the clock signal CKa shifts to an L level (refer to time t2), the switch SW2 is inactivated. As a result, the voltage at the inverting input terminal of the operational amplifier 22A becomes the voltage that is held by the capacitor C22 immediately before the switch SW2 is inactivated, that is, the voltage corresponding to the charge Q of the capacitor C31 at time t2.

Then, when the clock signals CKa, CKb, and CKc respectively have an H level, an L level, and an L level, the switch SW1 is activated (refer to time t3). In other words, the switch SW1 is activated after a certain time elapses from when the switch SW2 is activated. As a result, the voltage at the first terminal of the capacitor C21 becomes equal to the charge voltage Vch of the capacitor C31. Then, when the clock signal CKa shifts to an L level (refer to time t4), the switch SW1 is inactivated. As a result, the voltage at the non-inverting input terminal of the operational amplifier 22A becomes the voltage that is held by the capacitor C21 immediately before the switch SW1 is inactivated, that is, the voltage corresponding to the charge Q of the capacitor C31 at time t4. As mentioned above, the voltage at the inverting input terminal of the operational amplifier 22A is a voltage corresponding to the charge Q of the capacitor C31 at time t2. Thus, the amplified voltage Va output from the operational amplifier 22A in this state corresponds to the change amount ΔQ in the charge Q of the capacitor C31. In other words, the amplified voltage Va reflects the characteristics of the capacitor C31. The reference value generation circuit 24 holds the amplified voltage Va as the hold voltage Vh in response to an H level clock signal CKc and generates the reference voltage Vr in accordance with the held hold voltage Vh. This generates the reference voltage Vr in accordance with the characteristics of the capacitor C31 that is actually coupled to the light emitting diode 31.

Such series of operations are repeated. When the charge voltage Vch of the capacitor C31 reaches the certain set voltage (refer to time t5), an L level charge signal Sch is sent to the control circuit 20. In response to the L level charge signal Sch, the switch SW0 is inactivated, and the common terminal Pc is coupled to the second terminal P2 in the selector 27 thereby coupling the measurement circuit 22 and the control unit 23. This ends the charging of the capacitor C31, that is, the charge period of the capacitor C31.

Next, for example, when the user fully presses the shutter button, the host CPU 19 sends an H level light emission signal SL to the control circuit 20 (refer to time t6). This couples the common terminal and first terminal of the switch SW3. Further, a control signal Sc from the control unit 23 activates the transistor T31 in the light emission unit 30 and controls the ON resistor of the transistor T31. The control signal when discharging is started is a preset fixed voltage. In accordance with the ON resistance of the transistor T31 that is controlled by such a control signal Sc, the charge Q is discharged from the capacitor C31, and drive current Id flows from the capacitor C31 to the light emitting diode 31. In other words, the discharge period of the capacitor C31 (light emission period of the light emitting diode 31) is started. As illustrated in FIG. 3, during the discharge period, the charge Q of the capacitor C31 gradually decreases.

In this state, the clock signal CKa, which has a certain frequency, the clock signal CKb, which is obtained by dividing the frequency of the clock signal CKa by two, and the clock signal CKc, which is obtained by dividing the frequency of the clock signal CKa by four are generated. Here, the clock signal CKb has a logic that is inverted from the charge period. Thus, the timing at which the clock signals CKa, CKb, and CKc respectively have an H level, an L level, and an L level are generated first (refer to time t6), and the switch SW1 is generated first. Then, when the clock signal CKa shifts to an L level, the switch SW1 is inactivated (refer to time t7). When the clock signal CKa shifts to an H level, the switch SW2 is activated (refer to time t8). Then, when the clock signal CKa shifts to an L level, the switch SW2 is inactivated (refer to time t9). In this manner, during the discharge period of the capacitor C31, the switches SW1 and SW2 are activated in an order that is reversed from that of the charge period. Thus, even in the discharge period in which the changing direction (inclination direction) of the charge Q is reversed from that of the charge period, the change amount ΔQ (absolute value) in the charge Q may be measured. For example, in the operational amplifier 22A in this state, the non-inverting input terminal is supplied with the voltage corresponding to the charge Q of the capacitor C31 at time t7, and the inverting input terminal is supplied with the voltage corresponding to the charge Q of the capacitor C31 at time t9. Thus, the operational amplifier 22A outputs the amplified voltage Va that corresponds to the change amount ΔQ in the charge Q during a certain period (time t7 to t9). In other words, the amplified voltage Va in this state is in accordance with the drive current Id flowing through the light emitting diode 31. In the control unit 23, the control signal Sc is generated in accordance with the difference between the amplified voltage Va and the reference voltage Vr generated during the charge period. This controls the ON resistance of the transistor T31 so that the amplified voltage Va is equal to the reference voltage Vr.

For example, as illustrated in FIG. 4, when the measured amplified voltage Va is less than the reference voltage Vr (refer to time t10), the control signal Sc output from the operational amplifier 23A increases (refer to arrow). This decreases the ON resistance of the transistor T31 and increases the drive current Id flowing from the capacitor C31 to the light emitting diode 31. In this state, the increase in the drive current Id increases the change amount ΔQ in the charge Q of the capacitor C31, and the amplified voltage Va increases and approaches the reference voltage Vr. Further, as the drive current Id increases, the light emission amount of the light emitting diode 31 increases.

In contrast, when the measured amplified voltage Va is greater than the reference voltage Vr, the control signal Sc output from the operational amplifier 23A decreases. This increases the ON resistance of the transistor T31 and decreases the drive current Id. In this state, the decrease in the drive current Id decreases the change amount ΔQ in the charge Q of the capacitor C31, and the amplified voltage Va decreases and approaches the reference voltage Vr. The repetition of such operations controls the drive current Id flowing to the light emitting diode 31 to be generally constant. As a result, the light emission amount of the light emitting diode 31 is generally constant.

The present embodiment has the advantages described below.

(1) The change amount ΔQ in the charge Q of the capacitor C31, which is coupled to the light emitting diode 31, is measured. The light emission amount of the light emitting diode 31 is controlled in accordance with the difference between the amplified voltage Va, which corresponds to the change amount ΔQ in the charge Q, and the reference voltage Vr. In this manner, the drive current Id is measured in a simulated manner from the measurement of the change amount ΔQ in the charge Q. Thus, the value of the drive current Id may be accurately controlled, and the light emission amount of the light emitting diode 31 may be accurately controlled. This eliminates the necessity to provide an excessive design for the drive current Id. Further, a sense resistor is not used to measure the drive current. Thus, losses that would result from a sense resistor are not produced, and the power consumed to control the light emission amount of the light emitting diode 31 is suppressed.

(2) During the charge period of the capacitor C31, the reference voltage Vr is generated in accordance with the change amount ΔQ in the charge Q of the capacitor C31 (characteristic value of the capacitor C31). This generates the reference voltage in accordance with the characteristic value of the capacitor C31 that is actually coupled to the light emitting diode 31. Thus, the reference voltage Vr is applicable to changes in the capacitance of the capacitor C31 and corrections in the temperature characteristics.

(3) The capacitor C31 is charged by the current Ic supplied from the DC-DC converter 21, and the capacitor C31 is discharged to supply the drive current Id to the light emitting diode 31. In this manner, the control circuit 20 and the light emission unit 30 do not incorporate a constant current source that supplies the drive current Id to the light emitting diode 31. This prevents the generation of heat in the control circuit 20 and the light emission unit 30 in a preferable manner.

It should be apparent to those skilled in the art that the present invention may be embodied in many other specific forms without departing from the spirit or scope of the invention. Particularly, it should be understood that the present invention may be embodied in the following forms.

In the above embodiment, the change amount ΔQ in the charge Q of the capacitor C31 is measured during the charge period of the capacitor C31, and the reference voltage Vr is generated in accordance with the change amount ΔQ. Instead, the reference voltage Vr may be generated in accordance with the characteristic of the capacitor C31 during, for example, a certain period when the capacitor C31 is discharged (e.g., time during when a discharge period starts to when the change amount ΔQ is measured once).

The control executed during the charge period (generation of the reference voltage Vr) may be eliminated. In this case, for example, the reference voltage Vr may be set beforehand in accordance with the characteristics of the capacitor C31. This would also obtain characteristic (1) of the above embodiment.

The control circuit 20 may be applied to a lighting device that illuminates the light emitting diode 31 with a constant current.

In the above embodiment, the N-channel MOS transistor T31 is used as one example of a resistor element. However, a P-channel MOS transistor may also be used. Further, a variable resistor of which resistance is varied by the control signal Sc may also be used as the resistor element.

In the above embodiment, the control signal Sc controls the ON resistance of the transistor T31 and controls the light emission amount of the light emitting diode 31. However, as long as the light emission amount of the light emitting diode 31 is controllable, the control subject of the control signal Sc is not particularly limited.

In the above embodiment, the light emitting element is the light emitting diode 31. However, the light emitting element is not limited to such a device.

In the above embodiment, the electronic device is the digital camera 1. However, the electronic device is not limited to such a device. For example, a video camera may be used as the electronic device.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment of the present invention has been described in detail, it should be understood that the various changes, substitutions, and alterations could be made hereto without departing from the spirit and scope of the invention.

What is claimed is:

1. An electronic device comprising:

a light emitting element;

a capacitor coupled to the light emitting element;

a measurement circuit that measures a change amount in charge of the capacitor; and a control circuit that controls a light emission amount of the light emitting element in accordance with a difference between the change amount in the charge and a reference value.

2. The electronic device according to claim 1, further comprising a resistor element coupled to the light emitting element, wherein the control circuit controls resistance of the resistor element to control the light emission amount.

3. The electronic device according to claim 1, further comprising:

a reference value generation circuit that generates the reference value based on the change amount in the charge; and a selector that couples the measurement circuit selectively to one of the control circuit and the reference value generation circuit, wherein the selector couples the measurement circuit to the reference value generation circuit when the measurement circuit measures the change amount in the charge during a first period, and the selector couples the measurement circuit to the control circuit when the measurement circuit measures the change amount in the charge during a second period.

4. The electronic device according to claim 3, wherein the first period is a charge period of the capacitor, and the second period is a discharge period of the capacitor.

5. The electronic device according to claim 4, further comprising a power supply circuit that supplies a constant current to the capacitor during the charge period, wherein the capacitor supplies current to the light emitting element during the discharge period.

6. A control circuit comprising:

a measurement circuit that measures a change amount in charge during a certain period; and a comparison circuit that compares the change amount in the charge measured by the measurement circuit with a reference value.

7. The control circuit according to claim 6, further comprising:

a reference value generation circuit that generates the reference value based on the change amount in the charge measured by the measurement circuit; and a selector that couples the measurement circuit selectively to one of the comparison circuit and the reference value generation circuit, wherein the selector couples the measurement circuit to the reference value generation circuit when the measurement circuit measures the change amount in the charge during a first period, and the selector couples the measurement circuit to the comparison circuit when the measurement circuit measures the change amount in the charge during a second period.

8. The control circuit according to claim 6, wherein the measurement circuit measures a change amount in charge of a capacitor coupled to a light emitting element as the change amount in the charge, and the comparison circuit controls a light emission amount of the light emitting element.

9. The control circuit according to claim 8, wherein the first period is a charge period of the capacitor, and the second period is a discharge period of the capacitor.

10. A method for controlling a light emitting element, the method comprising:

measuring a change amount in charge of a capacitor coupled to the light emitting element; and controlling a light emission amount of the light emitting element in accordance with a difference between the measured change amount in the charge and a reference value.

* * * * *